United States Patent [19]

Jantzen

[11] 4,010,478

[45] Mar. 1, 1977

[54] PURGING SYSTEM FOR DIAZOTYPE FILM DEVELOPER

[75] Inventor: Johannes K. Jantzen, Mountain View, Calif.

[73] Assignee: Addressograph Multigraph Corporation, Cleveland, Ohio

[22] Filed: Aug. 14, 1975

[21] Appl. No.: 601,009

[52] U.S. Cl. ..... 354/300; 55/70; 34/79

[51] Int. Cl.² ..... G03D 7/00

[58] Field of Search ..... 354/297, 300; 34/79, 34/80, 85; 55/70

[56] References Cited

UNITED STATES PATENTS

| | | | |
|---|---|---|---|
| 2,431,041 | 11/1947 | Hassler | 354/300 |
| 2,696,771 | 12/1954 | Frantz | 354/300 X |
| 3,323,436 | 6/1967 | Hafer et al. | 354/300 |
| 3,720,150 | 3/1973 | Hurtig et al. | 354/300 X |
| 3,748,995 | 7/1973 | Schroter et al. | 354/300 |
| 3,836,987 | 9/1974 | Gibbons et al. | 354/300 |

FOREIGN PATENTS OR APPLICATIONS

| | | | |
|---|---|---|---|
| 341,972 | 1/1931 | United Kingdom | 354/300 |

*Primary Examiner*—Fred L. Braun
*Attorney, Agent, or Firm*—Michael A. Kondzella

[57] ABSTRACT

A purging system is provided for reducing and substantially eliminating contaminants, moisture, residual gas and the like from a work station such as, for example, a developer station in which ammonia gas is used for development of diazo type films. The system includes a check valve connected between one end of the developer station and a supply of compressed air, and a 3-way valve connected between the other end of the developer station and a supply of ammonia gas and an ammonia exhaust container. During development, the ammonia is passed into the developer station under a relatively high pressure and the flow of the ammonia is stopped by the check valve. After development, the pressure in the developer station is lowered thereby opening the check valve and causing flow of air from the supply of compressed air through the developer station, the 3-way valve, and into the exhaust container to thereby purge the entire system of contaminants, moisture and residual ammonia gas.

6 Claims, 1 Drawing Figure

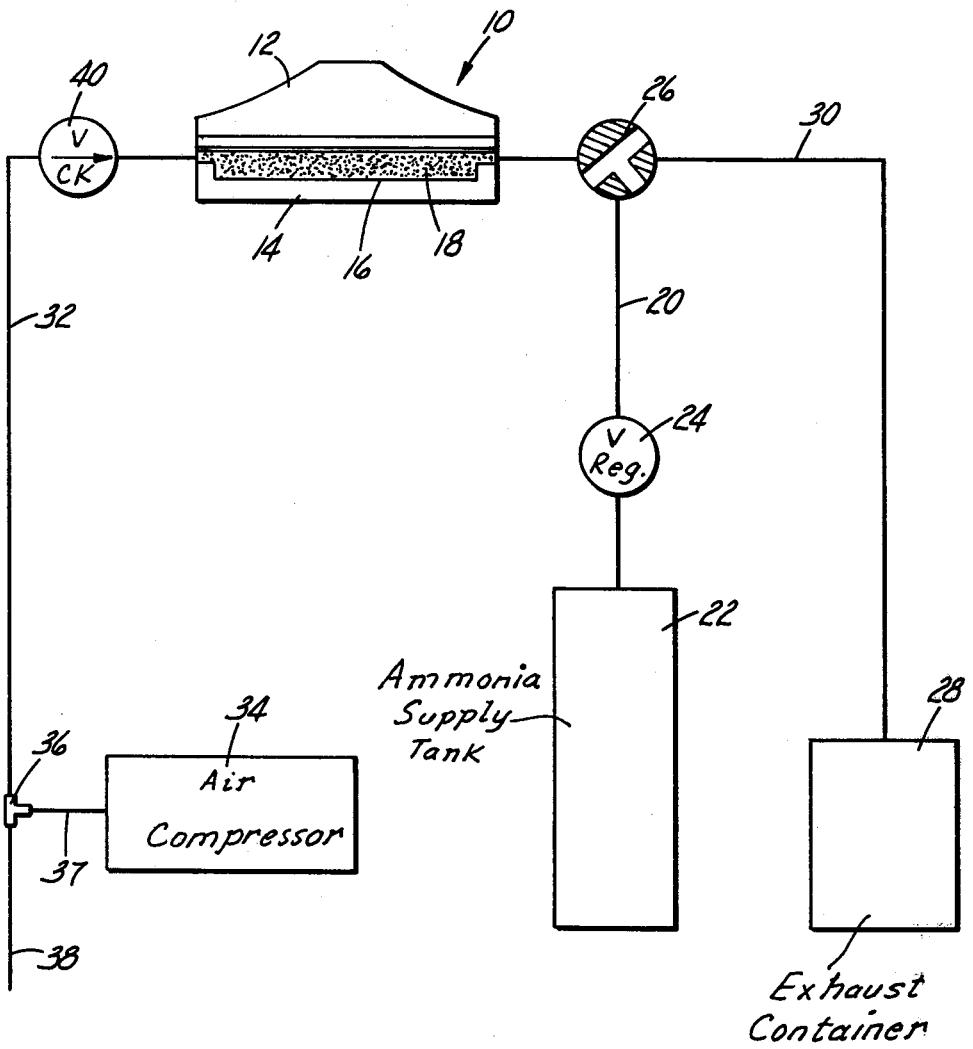
10
12
40
V
CK
26
30
14
16
18
32
20
24
V
Reg.
22
Ammonia
Supply
Tank
28
34
36
Air
Compressor
37
38
Exhaust
Container

PURGING SYSTEM FOR DIAZOTYPE FILM DEVELOPER

BACKGROUND OF THE INVENTION

Microfiche duplicating apparatus, wherein an unlimited number of duplicates of microfiche masters can be produced by means of contact printing, is well known in the art. One such apparatus is disclosed in U.S. Pat. No. 3,756,708.

As shown therein, the apparatus comprises a developer station including a pressure pad suspended within a frame and connected thereto by toggle linkage which actuates the developer pad -upward and downward within the developer station. The developer pad is provided with a plurality of bores which pass from edge to edge thereof, and a face of the developer pad is provided with a plurality of holes connecting the face with the bores. The linkage, when actuated, exerts a substantial force on the developer pad to press the pad tightly against a developer chamber so that the chamber will be sealed against a high pressure anhydrous ammonia used for the development of the diazo type films. When the pad face presses against the film, any entrapped air escapes through the holes and into the bores.

Although the foregoing has met with a considerable amount of success; it does not provide means for cleaning or purging the developer chamber of condensed moisture and residual ammonia after each development cycle thereby resulting in film spotting due to moisture and discoloration of the film due to predevelopment. Also, there are no provisions in the device of the above patent for eliminating the undesirable ammonia smell.

SUMMARY OF THE INVENTION

The present invention provides a purging system for cleaning the developer station by reducing and substantially eliminatng moisture, residual ammonia gas and odor to provide high quality development of diazo type films.

The system comprises a check valve provided in an air flow line extending between one end of the developer station and a compressed air supply, and a 3-way valve means in an ammonia supply line extending between the other end of the developer station and an ammonia supply. The 3-way valve means is also associated with an exhaust line terminating in an ammonia exhaust container.

During a development cycle, the ammonia is introduced into the developer station under relatively high pressure and the flow of the ammonia is arrested by the check valve. After development, the pressure in the developer chamber is reduced thereby causing the check valve to open to permit passage therethrough of air from the compressed air supply. The air is also passed through the developer chamber and the 3-way valve means to the exhaust container thereby purging the entire system of contaminants, moisture, residual ammonia gas and ammonia smell.

It is an object of the present invention to provide a purging system for reducing and substantially eliminating moisture, residual ammonia gas and ammonia odor from the developer chamber of a development station in which ammonia is used for development of diazo type films.

Another object of the invention is to provide a purging system which, as a result of removing moisture and residual ammonia from the developer chamber, provides for high quality development of the film free of blemishes such as spotting and/or discoloration of the film.

A feature of the invention is to provide a purging system which is economical to produce, reliable in operation and can be readily installed on existing machines.

Other objects, features and advantages of the invention wll appear hereinafter as the description proceeds.

IN THE DRAWING

The single FIGURE is a schematic of a system for purging an ammonia gas developer station in accordance with the present invention.

PREFERRED EMBODIMENT OF THE INVENTION

While the gas purging system of the present invention may be used in various applications, it is particularly suited for use with a microfiche duplicating apparatus as disclosed, for example, in the patent referred to hereinabove. Accordingly, a brief description of the duplicating apparatus will be given hereinbelow.

The duplicating apparatus is designed to produce microfiche made from a single section of film according to COSATI (microfiche with dimensions of 105mm × 148mm) or other specifications from various kinds of microfiche masters. Among the masters now in general use are those in which microfilm images from a roll of 16mm microfilm are cut into strips of the proper length and then bonded to a backing sheet.

Another master involves the use of 16mm microfilm strips inserted into elongate pockets in a transparent carrier card. Master microfiche may also be produced by means of a step and repeat camera which produces a series of images on an unexposed section of film which film is then developed and cut to appropriate lengths.

The duplicating apparatus provides for the feeding of a strip of unexposed film from a roll film feeding station through an exposure station where a microfiche master may be placed in juxtaposition with a section of the unexposed film, thence to a developing station where the exposed section of film is developed and from there to a cut-off knife where the individual fiche are separated from the strip of film.

At the exposure station there is provided a master fiche tray for holding the fiche in a ready position for movement into alignment with the film passing through the machine. When the tray is moved inward, an actuating means pulls a platen on the tray inward in order to cause it to move slightly upward and press the fiche master tightly against the film for proper contact to permit exposure of the copy and proper duplication of the original material on the master.

In the developing station there is provided a developer pressure pad which, in addition to being provided with heating means, is adjustable to accommodate various types of film bases. As mentioned above, the pressure pad is provided with bores and holes such that when the pad face presses against the film, any entrapped air escapes through the holes and into the bores. The pressure pad is pressed tightly against a developer chamber of the developer station so that the chamber will be sealed against a high pressure anhydrous ammonia used for development of the film.

After development, the film is passed to a cut-off knife and from there to a collating and collecting device or to a simple collection hopper.

The purging system of the present invention provides for cleaning the developer chamber after each development cycle by removing from the developer chamber condensed moisture, residual ammonia and contaminants. As shown in the drawing, a development or work station is indicated generally by the reference numeral 10 and comprises an upper frame 12, a lower developer pad or work means 14 adapted for movement between an inoperative position spaced from the frame 12 and an operative position as shown in the drawing in pressure engagement with the frame 12 to perform a work operation or film development cycle and a developer chamber 16 for receiving a supply of anhydrous ammonia gas 18 to effect development of the film when the developer pad 14 is in the operative position.

The ammonia 18 is supplied to the chamber 16 via a supply flow line 20 connected at one end to the chamber 16 and at its other end to an ammonia supply tank 22. While the tank 22 provides pressure of about 125–150 psi, the flow line 20 is provided with a regulator 24 for maintaining the ammonia 18 introduced to the chamber 16 at about 80 psi pressure. Further, the flow line 20 is provided with a 3-way solenoid valve 26 (normally closed exhaust to atmosphere) positioned intermediate the chamber 16 and the regulator 24 for permitting flow of ammonia into the chamber 16 when the valve 26 is energized, and for permitting flow or exhaust of ammonia from the chamber to an exhaust container or absorber 28 via an exhaust line 30 when the valve 26 is deenergized. The valve 26 is energized and deenergized by suitable electrical circuit means, not shown in the drawing, in response to actuation of the developer pad 14 to the operative and the inoperative positions respectively.

At the other end of the chamber 16 there is provided an air flow line 32 extending from the chamber to an air compressor 34. The line 32 is connected to the compressor 34 by a tee fitting 36 on an output port line 37 of the compressor, whereby one end of the tee fitting is connected to the line 32 and the other end to a bleed or vent line 38 to vent the air in the line 32 to the atmosphere during a development operation and prevent dead end pressure and reduce noise and moisture in the system.

The air flow line 32 is also provided with a check valve 40, positioned intermediate the chamber 16 and the air compressor 34, which is operable between a closed and an open position. Thus, as the ammonia 18 is passed into the chamber 16, the check valve 40 is in the closed position to prevent escape of the ammonia from the chamber. After a development cycle, the pressure in the chamber drops to about 8 psi thereby operating the check valve to its open position to permit flow of air through the chamber 16 from the air compressor 34 which supplies an air pressure of about 10 psi to overcome the pressure of 8 psi of the check valve 40.

The check valve 40 is of conventional structure and, as such, is operable between open and closed positions in response to a medium supplied thereto, i.e., the check valve permits passage of the medium supplied thereto in one direction but prevents passage of the medium supplied thereto in the opposite direction. In the present invention, the check valve 40 is opened in response to the compressed air supplied thereto in one direction by the compressor 34, and is closed in response to the ammonia supplied in the opposite direction to the chamber 16.

In the operation of a developing and gas purging cycle, as the developer pad 14 is moved to its operative position it closes the check valve 40 and energizes the 3-way solenoid valve 26 to provide a supply path in the flow line 20 from the ammonia tank 22 to the chamber 16. The ammonia gas 18 is passed into the chamber 16 under 80 psi pressure and compresses any air trapped in the chamber into the air flow line 32 where it is stopped by the check valve 40. The film is then developed.

Thereafter, completion of the development cycle de-energizes the 3-way solenoid valve 26 to discontinue supply of ammonia from the tank 22 and to open a flow path to expel the ammonia from the chamber 16 to the exhaust container 28 via the exhaust line 30. At this time the developer pressure in the chamber 16 drops to below 10 psi pressure. This lowered pressure of about 8 psi causes the check valve 40 to open, thereby permitting air to flow from the compressor 34 supplying air at about 10 psi pressure through the air flow line 32.

The air flowing through the line 32 passes through the check valve 40, the chamber 16, the 3-way solenoid valve 26, the exhaust line 30 and into the exhaust container 28. This flow of air purges the entire system of contaminants, residual ammonia, moisture and odor. Following a purging operation, the developer pad 14 is moved to its inoperative position while the compressor 34 continues to operate to exhaust air into the chamber 16 and into the atmosphere until a subsequent cycle of operation is initiated.

From the foregoing, it will be appreciated that the present invention provides a gas purging system which is simple in construction and reliable in operation. The arrangement of providing a flow of air under relatively low pressure through the developer chamber is effective to reduce and substantially eliminate residual ammonia gas and moisture which cause discoloration and spotting of the developed film respectively, and also eliminates the undesirable smell associated with ammonia gas.

What is claimed is:

1. A system for purging gas from a work station comprising:

work means actuable from an inoperative position to an operative position to perform a work operation and return to the inoperative position;

means for supplying gas under pressure to the work station during a work operation;

valve means operable between a first position to permit flow of gas from the supply means to the work station during a work operation, and a second position to permit exhausting the gas from the work station;

a check valve operable between a closed position to prevent escape of gas from the work station during a work operation, and an open position to permit flow of compressed air therethrough when the valve means is in the second position; and means for supplying compressed air to work station when the check valve is in the open position to perform a purging operation of the work station;

said work means being actuated from the operative to the inoperative position following a purging operation of the work station while the compressed air continues to be supplied to the work station until a subsequent work operation is initiated.

2. A system as set forth in claim 1 further comprising:

an exhaust container for collecting the gas exhausted from the work station; and an exhaust flow line extending from the valve means to the exhaust container for delivering the gas thereto.

3. A system as set forth in claim 1 in which the valve means comprises a 3-way solenoid valve operable to the first position in response to initiation of a work operation, and operable to the second position in response to completion of a work operation.

4. A system as set forth in claim 1 in which the check valve is operable to the closed position in response to initiation of a work operation, and operable to the open position in response to the gas pressure at the work station being lowered to a predetermined pressure on completion of a work operation.

5. A system as set forth in claim 1 in which the means for supplying compressed air to the work station comprises:

an air compressor;

an air flow line extending from the air compressor to the work station; and a vent line for venting the air in the air flow line to the atmosphere when the check valve is in the closed position.

6. A system for purging contaminants from a developer station using ammonia gas for developing diazo type materials, comprising:

developer means actuable from an inoperative to an operative position to perform a development cycle and return to the inoperative position;

an ammonia gas supply for supplying gas under pressure to the developer station during a development cycle;

valve means operable between a first position to permit flow of gas from the gas supply to the developer station during a development cycle, and a second position to permit exhausting the gas from the developer station;

a check valve operable between a closed position to prevent escape of the gas from the developer station during a development cycle, and an open position to permit flow of compressed air therethrough when the valve means is in the second position;

a compressed air supply means for supplying air to the developer station when the check valve is in the open position to perform a purging operation for purging the developer station of contaminants;

an exhaust container for collecting the contaminants from the developer station; and an exhaust flow extending from the valve means to the exhaust container for delivering the contaminants to the exhaust container when the valve means is in the second position;

said developer means being actuated from the operative to the inoperative position following a purging operation of the developer station while the compressed air continues to be supplied to the developer station until a subsequent development cycle is initiated.

* * * * *